US007216450B2

(12) United States Patent
Pikielny

(10) Patent No.: US 7,216,450 B2
(45) Date of Patent: May 15, 2007

(54) FRAME ASSEMBLY OF HANDGUN WITH DIFFERENT HARDNESSES

(76) Inventor: Dov Pikielny, 7 Dov Hoz Street, Herzliya 46581 (IL)

( * ) Notice: Subject to any disclaimer, the term of this patent is extended or adjusted under 35 U.S.C. 154(b) by 33 days.

(21) Appl. No.: 11/250,466

(22) Filed: Oct. 17, 2005

(65) Prior Publication Data

US 2007/0084101 A1 Apr. 19, 2007

(51) Int. Cl.
*F41C 23/10* (2006.01)
*F41C 23/18* (2006.01)

(52) U.S. Cl. ..... 42/71.01; 42/7; 42/71.02

(58) Field of Classification Search ..... 42/7, 42/71.01, 71.02, 75.02, 106
See application file for complete search history.

(56) References Cited

U.S. PATENT DOCUMENTS 2,439,137 A * 4/1948 Keller ..... 428/171
3,023,527 A * 3/1962 Leek et al. ..... 42/71.01
3,696,706 A * 10/1972 Seidel et al. ..... 89/196
5,632,108 A * 5/1997 Ruger et al. ..... 42/1.01
5,864,978 A * 2/1999 McRary et al. ..... 42/71.01
6,112,446 A * 9/2000 Forster et al. ..... 42/71.02
6,401,379 B1 * 6/2002 Moon ..... 42/71.02

FOREIGN PATENT DOCUMENTS

DE 9304489 U1 8/1993
DE 19910162 A1 8/2000
DE 10122663 C1 8/2002

* cited by examiner

*Primary Examiner*—Michael J Carone
*Assistant Examiner*—Bret Hayes
(74) *Attorney, Agent, or Firm*—Dekel Patent Ltd; David Klein

(57) ABSTRACT

A handgun including a one-piece frame assembly including a slide interface portion, a grip portion and a trigger guard, wherein the frame assembly includes at least two portions that have different hardnesses, and a firing assembly that includes a slide supported for reciprocal longitudinal sliding movement on the slide interface portion.

11 Claims, 2 Drawing Sheets

FIG. 2

FRAME ASSEMBLY OF HANDGUN WITH DIFFERENT HARDNESSES

FIELD OF THE INVENTION

The present invention relates generally to handguns, and particularly to a handgun that includes a frame assembly having different hardnesses, e.g., a polymer frame assembly with some of the polymer being harder than other portions of the polymer.

BACKGROUND OF THE INVENTION

It has been common practice in the art of weapons to manufacture handguns and other firearms from different hard materials, such as different metals, with or without a combination of wood or hard plastics. This combination of materials has several advantages, such as saving money and time in production, reducing weight and other benefits.

Starting in the late 1970's, early 1980's, different handgun manufacturers like Glock, Steyr, Walther, H&K, Taurus and others started producing firearms and mainly handguns from different hard polymers. In the prior art, polymer handguns are made of one single type of polymer, with all portions of the polymer body having the same basic hardness.

SUMMARY OF THE INVENTION

The present invention seeks to provide a handgun that includes a frame assembly having different hardnesses, as is described more in detail hereinbelow.

There is provided in accordance with an embodiment of the present invention a handgun including a one-piece frame assembly including a slide interface portion, a grip portion and a trigger guard, wherein the frame assembly includes at least two portions that have different hardnesses, and a firing assembly that includes a slide supported for reciprocal longitudinal sliding movement on the slide interface portion. For example, the slide interface portion (and the trigger guard) may be harder than the grip portion. The slide interface portion may be harder than the trigger guard. Front and rear structural members of the slide interface portion, which are located in areas subject to firing-related high stress, may be harder than other portions of the slide interface portion.

The one-piece frame assembly may be fabricated by injection molding a relatively high hardness polymer and the grip portion is formed by over-molding a softer material over the polymer. Alternatively, the one-piece frame assembly may be fabricated by multiple injection molding, wherein the slide interface portion is molded of a relatively high hardness polymer and the grip portion is molded of a softer material. As another alternative, the one-piece frame assembly may be fabricated by injection of a polymer that is cured and hardened to different levels of hardness such that the slide interface portion is harder than the grip portion.

BRIEF DESCRIPTION OF THE DRAWINGS

The present invention will be understood and appreciated more fully from the following detailed description taken in conjunction with the drawings in which.

DETAILED DESCRIPTION OF EMBODIMENTS

Figure 1:
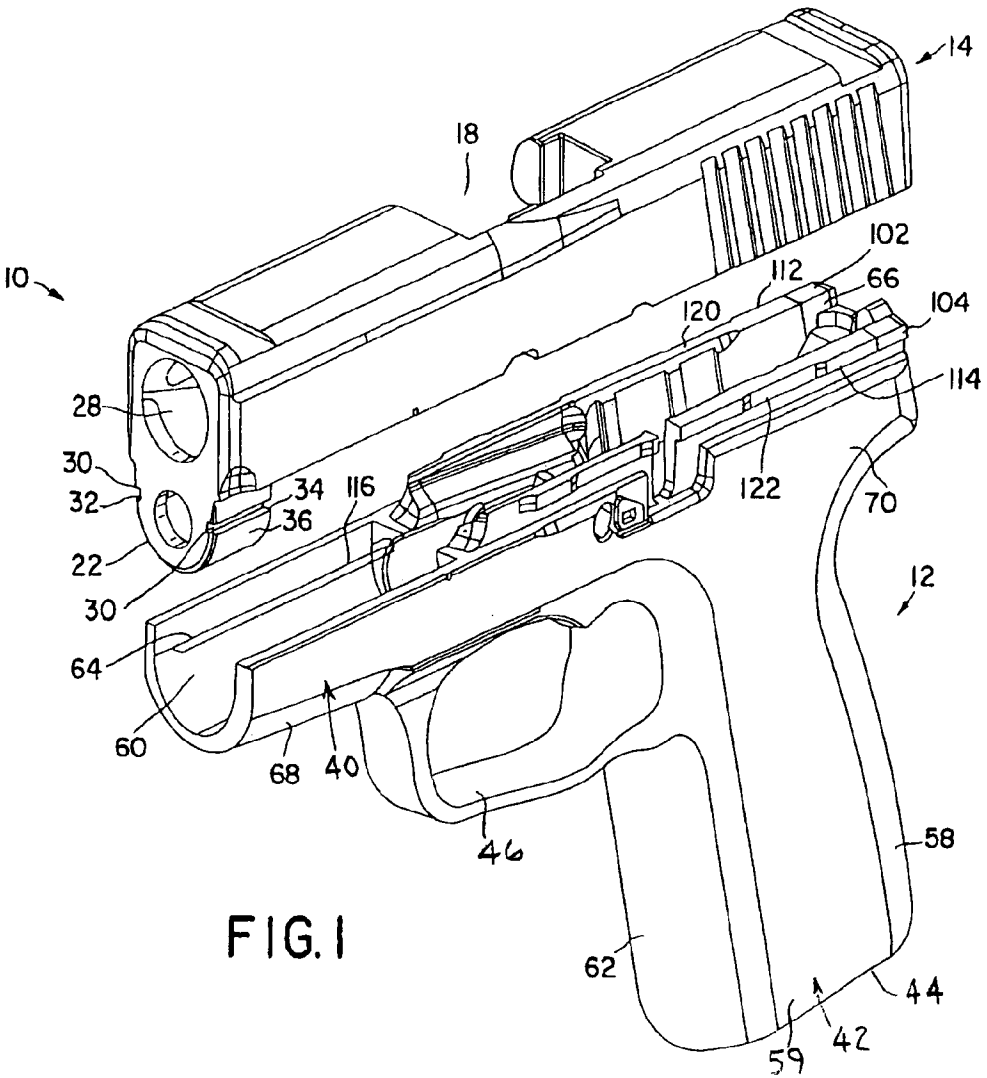
FIG. 1 is a simplified exploded illustration of a handgun constructed and operative in accordance with an embodiment of the present invention.

Reference is now made to FIG. 1, which illustrates a handgun 10, constructed and operative in accordance with an embodiment of the present invention. The illustrated handgun is based on an illustration found in U.S. Pat. No. 6,401,379, but this is merely for the sake of simplicity and clarity, and the present invention is in no way limited by this particular illustrated construction.

Handgun 10 may have a frame assembly 12 and a firing assembly that includes a slide 14. Those skilled in the art will readily appreciate that only those parts of handgun 10 that are needed to explain the present invention are shown, but the firing assembly of handgun 10 in actuality may include many other parts, such as but not limited to, a barrel, a breech block, a trigger, a trigger bar, a sear, a striker, and various springs that are well known in the art and are therefore do not require detailed description and are omitted in the drawing for the sake of simplicity.

Briefly, slide 14 may have a laterally open ejection port 18, and a front end segment 22. An upper portion of the front end segment 22 may have an opening 28 for receiving the muzzle of the barrel (not shown) as is known in the art. A lower portion of the front end segment 22 may have a front pair 30 of oppositely disposed, first and second grooves 32 and 34 formed in an exterior surface 36. The first and second grooves 32 and 34 may extend longitudinally the full length of the right and left sides of front end segment 22. Slide 14 may be constructed of a high strength metal (e.g., alloy steel) as is well known in the art.

Slide 14 may be supported on frame assembly 12, for reciprocal longitudinal sliding movement between battery and retired positions, by a pair of primary rails 116 (one of which is seen in FIG. 1) which are disposed within grooves 32 and 34, and secondary rails 112 and 114 which are disposed within a rear pair of grooves (not shown) of slide 14. Right and left rail segments 102 and 104 may extend rearward from secondary rails 112 and 114, respectively. A recoil spring assembly (not shown), which may include a recoil spring and a recoil spring guide (not shown), may act between the forward end of slide 14 and a forwardly facing surface on frame assembly 12 to bias slide 14 in a forward direction toward the battery position.

Frame assembly 12 may include a slide interface portion 40 that has front and rear portions 68 and 70, respectively. The slide interface portion 40 may have an upwardly open channel 60 extending generally from one end to the other end of frame assembly 12. The slide interface portion 40 is adapted to house the firing mechanism (not shown) of the firing assembly and cooperate with slide 14 to house the barrel (not shown).

The front and rear portions 68 and 70 may respectively include front and rear structural members 64 and 66, located in an area of the slide interface portion 40 that is subject to firing-related high stress.

Frame assembly 12 may include a grip portion 42 that has a magazine well 44 for inserting therein a magazine (not shown). Grip portion 42 may have (integrally formed therewith) a front strap 62, a back strap 58 and side panels 59. The slide interface portion 40 may include magazine lips 120 and 122 for catching the upper end of the magazine.

Frame assembly 12 may further include a trigger guard 46.

Figure 2:
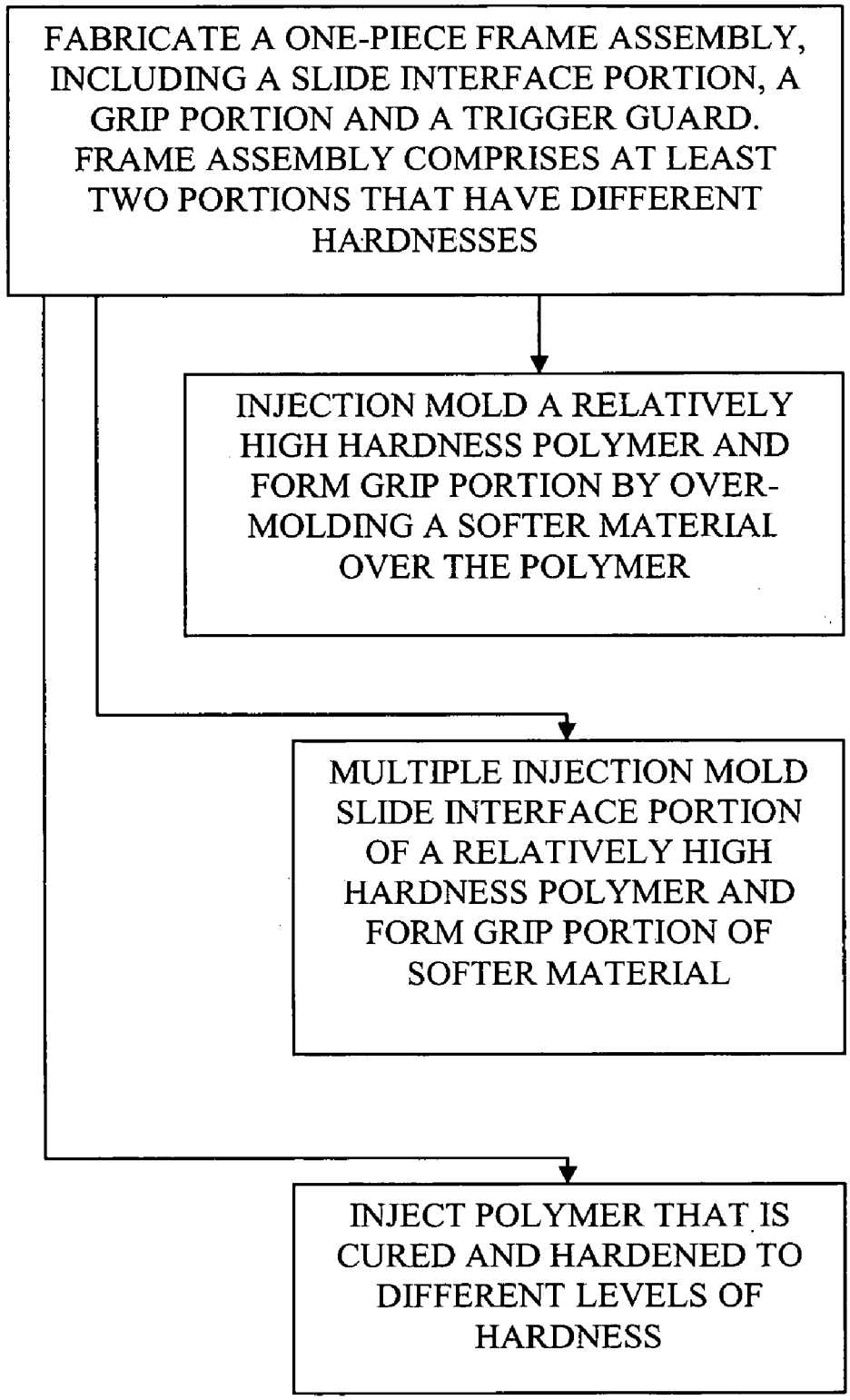
FIG. 2 is a simplified illustration of a method for constructing the handgun of FIG. 1.

In accordance with an embodiment of the invention, frame assembly 12 includes at least two portions that have different hardnesses. For example, slide interface portion 40 may be harder than grip portion 42. This may be accomplished by several methods, as is now explained with further reference to FIG. 2.

In one example, frame assembly 12 may have a unitary (one-piece) structure, e.g., fabricated by injection molding a high strength, heat and corrosion resistant polymer, which has a relatively high hardness, such as but not limited to, nylon 6/6 or commercially available polymer RTP 299H54780. Grip portion 42 may be formed by over-molding a softer material over the high strength polymer base. For example, in the over-molding process, a well known technique in the molding art, a soft TPE (Thermo-Plastic Elastomer) may be molded over a base of a rigid material (e.g., nylon 6/6). In this example, grip portion 42 has two layers, wherein the outer layer is softer than the inner layer, thus providing a good hold and grip of handgun 10. The slide interface portion 40 is made just of the hard polymer and is thus harder than grip portion 42.

In another example, frame assembly 12 may have a unitary (one-piece) structure made by the process of double or multiple injection, a well known technique in the molding art. Double injection can inject two colors or two different materials (e.g., ABS and rubber, or nylon 6/6 and silicone rubber) in the same mold and process (multiple injection is the more general term and includes injecting two or more materials). It reduces costs by the use of a single operation. (See, for example, U.S. Pat. Nos. 4,701,292, 4,808,101 or 6,352,427). By using well known double or multiple injection techniques, slide interface portion 40 may be constructed of a harder polymer (e.g., injection molded of nylon 6/6) than grip portion 42 (e.g., injection molded of TPE).

In yet another example, frame assembly 12 may have a unitary (one-piece) structure made by single injection of a polymer that is cured and hardened to different levels of hardness such that slide interface portion 40 is harder than grip portion 42. Alternatively, frame assembly 12 may have a unitary (one-piece) structure made by machining or casting a single metal or more than one metal, which may be heat-treated to different levels of hardness such that slide interface portion 40 is harder than grip portion 42. For example, slide interface portion 40 may be surface hardened to a relatively high Rockwell C hardness while grip portion 42 may be annealed to be softer.

In all of the above examples, trigger guard 46 may be constructed together with slide interface portion 40, and may thus be harder than grip portion 42, too. Alternatively, trigger guard 46 may be constructed of another material with an intermediate hardness, less than that of slide interface portion 40 but more than that of grip portion 42.

As another example, because the front and rear structural members 64 and 66 are located in areas subject to firing-related high stress, front and rear structural members 64 and 66 may be hardened or may be injection molded of higher hardness than grip portion 42 (or than other portions of slide interface portion 40).

It will be appreciated by persons skilled in the art that the present invention is not limited by what has been particularly shown and described hereinabove. Rather the scope of the present invention includes both combinations and sub-combinations of the features described hereinabove as well as modifications and variations thereof which would occur to a person of skill in the art upon reading the foregoing description and which are not in the prior art.

What is claimed is:

1. A handgun comprising:

a one-piece frame assembly comprising a slide interface portion, a grip portion and a trigger guard, wherein said frame assembly comprises at least two portions that have different hardnesses; and a firing assembly that comprises a slide supported for reciprocal longitudinal sliding movement on said slide interface portion, wherein said slide interface portion and said trigger guard are harder than said grip portion.

2. The handgun according to claim 1, wherein said slide interface portion is harder than said trigger guard.

3. The handgun according to claim 1, wherein front and rear structural members of said slide interface portion which are located in areas subject to firing-related high stress, are harder than other portions of said slide interface portion.

4. The handgun according to claim 1, wherein said one-piece frame assembly is fabricated by injection molding a relatively high hardness polymer and said grip portion is formed by over-molding a softer material over said polymer.

5. The handgun according to claim 1, wherein said one-piece frame assembly is fabricated by multiple injection molding, wherein said slide interface portion is molded of a relatively high hardness polymer and said grip portion is molded of a softer material.

6. The handgun according to claim 1, wherein said one-piece frame assembly is fabricated by injection of a polymer that is cured and hardened to different levels of hardness such that said slide interface portion is harder than said grip portion.

7. Apparatus comprising:

one-piece frame assembly for use with a handgun that comprises a firing assembly that has a slide supported for reciprocal longitudinal sliding movement on said frame assembly, the frame assembly comprising a slide interface portion, a grip portion and a trigger guard, wherein said frame assembly comprises at least two portions that have different hardnesses, and wherein said slide interface portion and said trigger guard are harder than said grip portion.

8. The apparatus according to claim 7, wherein said slide interface portion is harder than said trigger guard.

9. A method for fabricating a frame assembly for use with a handgun that comprises a firing assembly that has a slide supported for reciprocal longitudinal sliding movement on said frame assembly, the method comprising:

fabricating a one-piece frame assembly comprising a slide interface portion, a grip portion and a trigger guard, wherein said frame assembly comprises at least two portions that have different hardnesses, wherein said one-piece frame assembly is fabricated by injection molding a relatively high hardness polymer and forming said grip portion by over-molding a softer material over said polymer.

10. A method for fabricating a frame assembly for use with a handgun that comprises a firing assembly that has a slide supported for reciprocal longitudinal sliding movement on said frame assembly, the method comprising:

fabricating a one-piece frame assembly comprising a slide interface portion, a grip portion and a trigger guard, wherein said frame assembly comprises at least two portions that have different hardnesses, wherein said one-piece frame assembly is fabricated by multiple injection molding, wherein said slide interface portion is molded of a relatively high hardness polymer and said grip portion is molded of a softer material.

11. A method for fabricating a frame assembly for use with a handgun that comprises a firing assembly that has a slide supported for reciprocal longitudinal sliding movement on said frame assembly, the method comprising:

fabricating a one-piece frame assembly comprising a slide interface portion, a grip portion and a trigger guard, wherein said frame assembly comprises at least two portions that have different hardnesses, wherein said one-piece frame assembly is fabricated by injection of a polymer that is cured and hardened to different levels of hardness such that said slide interface portion is harder than said grip portion.

* * * * *